US009265320B2

(12) United States Patent
Bridgeforth

(10) Patent No.: US 9,265,320 B2
(45) Date of Patent: Feb. 23, 2016

(54) FRAME ASSEMBLY FOR A CUSTOMIZED CARRYING BAG

(71) Applicant: Christopher D. Bridgeforth, Charlotte, NC (US)

(72) Inventor: Christopher D. Bridgeforth, Charlotte, NC (US)

( * ) Notice: Subject to any disclaimer, the term of this patent is extended or adjusted under 35 U.S.C. 154(b) by 0 days.

(21) Appl. No.: 14/297,618

(22) Filed: Jun. 5, 2014

(65) Prior Publication Data

US 2015/0351511 A1 Dec. 10, 2015

(51) Int. Cl.

| | |
|---|---|
| ***A45C 13/04*** | (2006.01) |
| *A45C 13/26* | (2006.01) |
| *A45C 13/30* | (2006.01) |
| *A45C 13/36* | (2006.01) |
| *A45C 5/14* | (2006.01) |
| *A45F 3/08* | (2006.01) |

(52) U.S. Cl.

CPC . *A45C 13/04* (2013.01); *A45C 5/14* (2013.01); *A45C 13/26* (2013.01); *A45C 13/30* (2013.01); *A45C 13/36* (2013.01); *A45F 3/08* (2013.01)

(58) Field of Classification Search

CPC ..... A45C 13/04; A45C 13/26; A45C 13/30; A45C 13/36; A45C 5/14; A45F 3/08

USPC ..... 190/124, 127, 25, 28, 37, 18 A, 115

See application file for complete search history.

(56) References Cited

U.S. PATENT DOCUMENTS

| | | | | | |
|---|---|---|---|---|---|
| 1,579,774 | A | * | 4/1926 | Lowy | 190/122 |
| 2,254,506 | A | * | 9/1941 | Wheary, Jr. | 16/409 |
| 2,531,302 | A | * | 11/1950 | Schwennicke | 190/115 |
| 3,526,921 | A | * | 9/1970 | Aupke | 16/43 |
| 3,989,128 | A | * | 11/1976 | Walker | 190/18 A |
| 5,127,563 | A | * | 7/1992 | Chan et al. | 224/438 |
| 5,330,141 | A | * | 7/1994 | Kim | 248/98 |
| 5,353,900 | A | * | 10/1994 | Stilley | 190/115 |
| 5,366,071 | A | * | 11/1994 | Laszlo | 206/218 |
| 5,833,039 | A | * | 11/1998 | Kotkins, Jr. | 190/18 A |
| 6,131,713 | A | * | 10/2000 | Sher | 190/122 |
| 2007/0175719 | A1 | * | 8/2007 | Lai | 190/115 |
| 2009/0301833 | A1 | * | 12/2009 | Hymas | 190/115 |

* cited by examiner

*Primary Examiner* — Tri Mai

(74) *Attorney, Agent, or Firm* — Christopher C. Dremann, P.C.; Christopher C. Dremann

(57) ABSTRACT

A frame assembly for a customized carrying bag includes a frame that defines a periphery and an interior compartment. The frame has a top, a bottom, and a pair of opposite sides that extend between and interconnect the ends of the top and the bottom. The frame may also include an upper rear flange adjacent the top and a pair of lower rear flanges adjacent the bottom and each of the sides. A plurality of frame brackets is secured onto the top, the bottom, the sides, the upper rear flange and the lower rear flanges of the frame. One or more connector pieces are attached to certain ones of the frame brackets. An accessory component, such as a pair of straps, a strap, a handle and/or an extensible handle, is attached to the connector piece so as to create a customized carrying bag.

15 Claims, 12 Drawing Sheets

FRAME ASSEMBLY FOR A CUSTOMIZED CARRYING BAG

FIELD OF THE INVENTION

The present invention relates generally to a frame assembly for a carrying bag. More particularly, the invention is a frame assembly that allows a user to customize the function and appearance of a carrying bag.

BACKGROUND OF THE INVENTION

Carrying bags for personal use, such as book bags, computer cases, back packs, briefcases, carry-on luggage and the like, are well known. The various types of carrying bags each have a different function and appearance. For example, book bags and computer cases typically include a single, relatively long strap that allows a user to support the weight of the bag by positioning the strap over his or her shoulder. In contrast, a backpack typically includes a pair of somewhat shorter length straps that allow a user to support the weight of the bag on his or her back by positioning one of the straps over each shoulder. Briefcases and carry-on luggage typically have one or more relatively short straps forming a handle that allows a user to grasp the handle and carry the bag with his or her hand. Alternatively, or in addition, carry-on luggage may include at least one wheel, roller or the like, and an extensible handle that allow a user to easily maneuver (i.e. roll) the carry-on luggage across a generally planar surface by grasping and pulling the handle.

Each of the various types of carrying bags is useful for its intended function. However, few are particularly useful for multiple functions. For example, a book bag or computer case may be provided with both a relatively long carrying strap and a relatively short handle. However, book bags and computer cases are not easily converted to be positioned, supported and carried on a user's back. Similarly, carry-on luggage may be provided with a pocket or sleeve configured to contain one or more books and/or a laptop computer. However, such luggage is not easily converted to include a relatively long strap for a user to carry the luggage over his or her shoulder.

Furthermore, each of the various types of carrying bags has a particular utility and appearance, and more specifically, a distinctive size and shape. Although the different types of carrying bags may be provided with various straps, handles, wheels, rollers or the like, none are configured to be easily converted from the utility and appearance of one to the utility and appearance of another.

Accordingly, what is needed is a frame assembly for a customized carrying bag. More particularly, a frame assembly is needed that is configured for creating a customized carrying bag, such as a backpack, a book bag or a computer case, a briefcase, or rolling carry-on luggage by easily and readily interchanging a strap and/or a handle.

SUMMARY OF THE INVENTION

In one exemplary embodiment, the invention is a frame assembly for a customized carrying bag including a frame defining a periphery and an interior compartment. The frame assembly further includes a plurality of frame brackets that are secured onto the frame. The frame assembly further includes at least one connector piece attached to a certain one of the frame brackets. The connector piece is configured to receive an accessory component so as to create the customized carrying bag.

In another exemplary embodiment, each frame bracket includes an inner frame bracket and an outer frame bracket secured onto the frame with the frame disposed therebetween. The frame has a plurality of smaller-diameter through holes and at least one larger-diameter through hole. The inner frame bracket has a plurality of smaller-diameter through holes corresponding to the smaller-diameter through holes of the frame and at least one larger-diameter tapped hole corresponding to the larger-diameter through hole of the frame. The outer frame bracket has a plurality of smaller-diameter tapped holes corresponding to the smaller-diameter through holes of the frame and at least one larger-diameter through hole corresponding to the larger-diameter through hole of the frame. The inner frame bracket and the outer frame bracket are secured together by a plurality of fasteners that pass through the smaller-diameter through holes of the inner frame bracket and the smaller-diameter through holes of the frame to engage the smaller-diameter tapped holes of the outer frame bracket.

In another exemplary embodiment, the connector piece has at least one larger-diameter through hole corresponding to the larger-diameter through hole of the outer frame bracket, the larger-diameter through hole of the frame, and the larger-diameter tapped hole of the inner frame bracket. The connector piece is attached to the certain one of the frame members by a fastener that passes through the larger-diameter through hole of the connector piece, the larger-diameter through hole of the outer frame bracket, and the larger-diameter through hole of the frame to engage the larger-diameter tapped hole of the inner frame bracket.

In still another exemplary embodiment, an accessory component is attached to the at least one connector piece attached to the corresponding certain ones of the frame brackets. By way of example and not limitation, the accessory component may be a pair of straps so as to create a customized backpack, a strap so as to create a customized book bag or a customized computer case, a handle so as to create a customized briefcase, and/or an extensible handle having at least one wheel, roller or the like so as to create a customized rolling carry-on luggage.

BRIEF DESCRIPTION OF THE DRAWING FIGURES

The invention, as well as the features, objects and advantages thereof set forth herein, will be better understood and appreciated when considered in light of the detailed description of exemplary embodiments thereof provided hereinafter and the accompanying drawing figures, wherein like reference characters indicate the same or similar parts, elements, components, assemblies and/or subassemblies of the invention.

DETAILED DESCRIPTION OF EXEMPLARY EMBODIMENTS OF THE INVENTION

Figure 1:
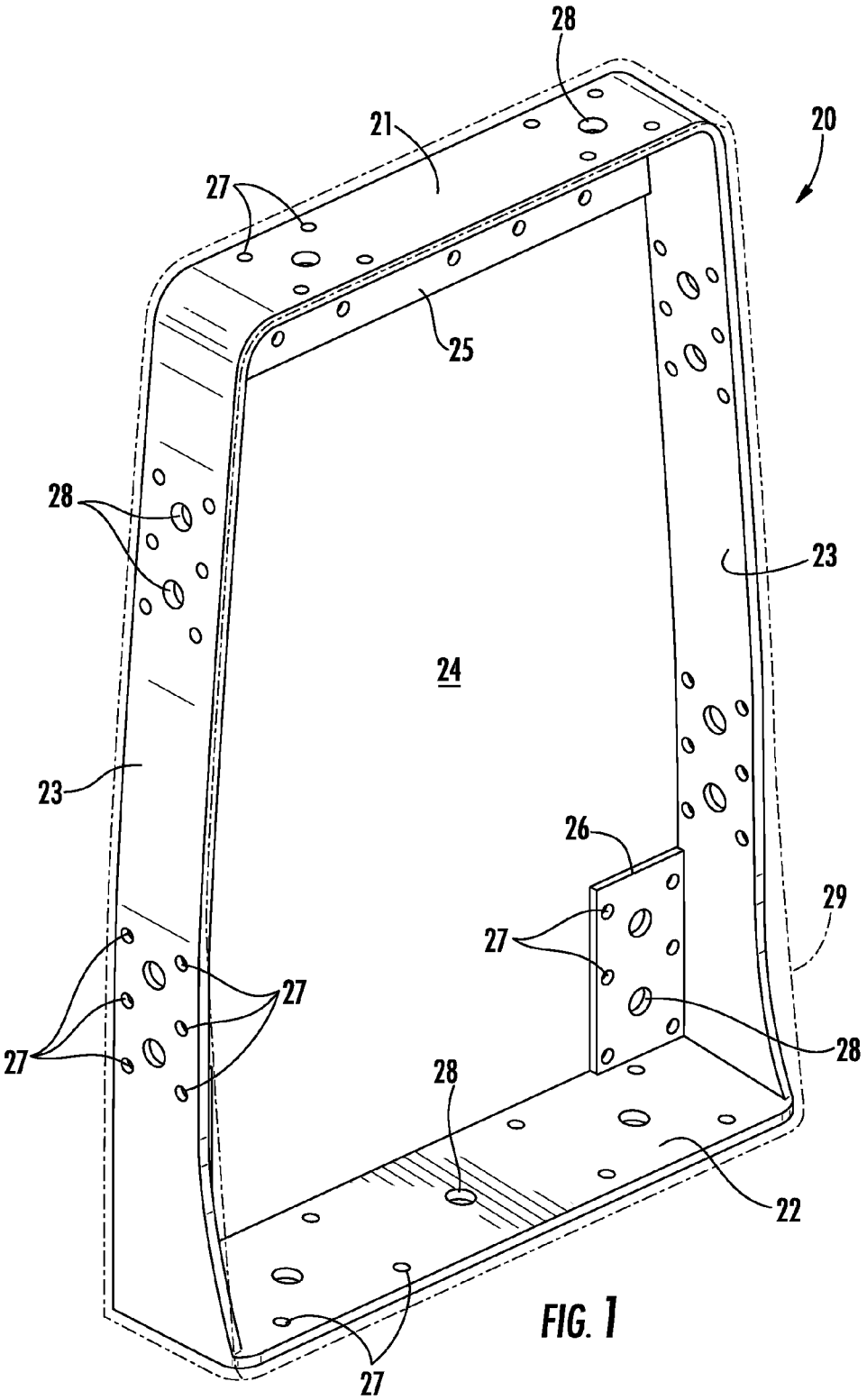
FIG. 1 is a front perspective view showing a frame configured for use with a frame assembly constructed in accordance with present invention.

The invention will be described more fully hereinafter with reference to the accompanying drawing figures in which exemplary embodiments are shown. However, it is to be understood that the invention may be embodied in many different forms and should not be construed as limited to the exemplary embodiments set forth herein. Exemplary embodiments of the invention are provided herein so that this disclosure will both fully convey the broad scope of the invention and enable one of ordinary skill in the art to make, use and practice the invention without undue experimentation. As previously mentioned, like reference characters in the detailed description and the accompanying drawing figures refer to the same or similar parts, elements, components, assemblies and/or subassemblies of the invention.

FIG. 1 shows a frame 20 configured for use with a frame assembly constructed in accordance with the present invention. For purposes of this description, frame 20 has a top 21, a bottom 22, and a pair of opposite sides 23 that extend between and join together ends of the top and bottom of the frame. The top 21, bottom 22 and sides 23 of the frame 20 together form a continuous periphery having a generally rectangular shape that defines a generally hollow interior compartment 24. As shown herein, frame 20 further has an upper rear flange 25 adjacent the top 21 that extends between the opposite sides 23 of the frame. In addition, frame 20 has a pair of lower rear flanges 26 adjacent the bottom 22, with each lower rear flange joining the bottom with one of the opposite sides 23 of the frame. Furthermore, frame 20 is provided with a plurality of smaller-diameter through holes 27, and a lesser plurality of larger-diameter through holes 28. By way of example, and as illustrated herein, the top 21 of frame 20 has a total of eight smaller-diameter holes 27 and two larger-diameter holes 28, while the bottom 22 has a total of eight holes 27 and three holes 28. Each opposite side 23 of the frame 20 has a total of twelve smaller-diameter holes 27 and four larger-diameter holes 28. Likewise, the upper rear flange 25 has a total of twelve smaller-diameter holes 27 and four larger-diameter holes 28, and the pair of lower rear flanges 26 together has a total of twelve holes 27 and four holes 28. Holes 27 and holes 28 are provided in the frame 20 for a purpose that will be described hereinafter.

Figure 2:
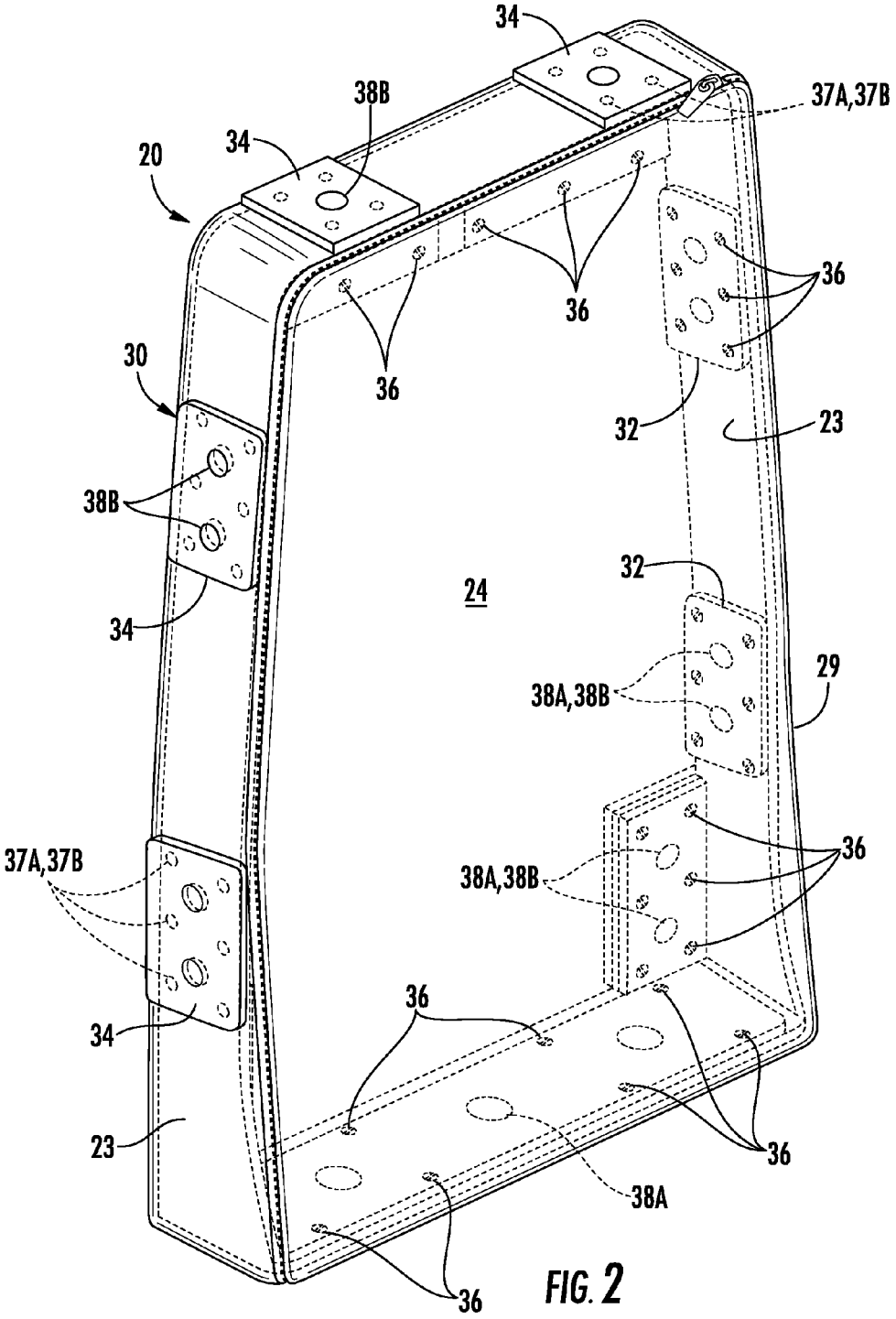
FIG. 2 is a front perspective view showing a plurality of frame brackets secured onto the frame of FIG. 1.

The frame 20 is made of a material that is somewhat flexible, yet tends to retain or return to its original shape once an applied force (e.g., a load) is removed. By way of example, frame 20 may be made of a soft plastic, such as polyurethane, or rubber material. In one embodiment, the frame 20 may be molded as a unitary component. Alternatively, the frame 20 may be formed in multiple components that are joined together, for example by an adhesive at overlapping joints. As shown herein, the top 21 of the frame 20 may be narrower in side-to-side width than the bottom 22. In addition, each of the opposite sides 23 may be narrower in depth adjacent the top 21 than adjacent the bottom 22. As a result, the interior compartment 24 may be wider and have more depth adjacent the bottom 22 than adjacent the top 21. Regardless, the frame 20 will be encased by a covering 29 made of a relatively flexible material. Covering 29 is removed and indicated by phantom lines in FIG. 1 for purposes of clarity. By way of example only, covering 29 may be made of a fabric, leather, vinyl or the like, provided with through holes matching the pattern of through holes 27 and through holes 28 formed in the frame 20. FIG. 2 shows a plurality of frame brackets 30 secured onto the somewhat flexible frame 20 described herein. When secured onto the frame 20, the frame and the frame brackets 30 together provide the desired structural rigidity for the frame assembly to be utilized as a customized carrying bag.

Each frame bracket 30 comprises an inner bracket 32 and an outer bracket 34. As will be described more fully and in greater detail with reference to FIG. 6 and FIG. 7, the inner bracket 32 and the outer bracket 34 are secured together with the frame 20 encased by the covering 29 disposed between the inner bracket and the outer bracket. As shown herein, inner bracket 32 is provided with a plurality of smaller-diameter through holes 37A and outer bracket 34 is provided with a plurality of smaller-diameter tapped (e.g. internally-threaded) holes 37B. Each hole 37A and each hole 37B align with a corresponding one of the smaller-diameter through holes 27 in the frame 20 and the matching through hole in the covering 29. A plurality of fasteners 36 pass through the holes 37A in the inner bracket 32 and engage the tapped holes 37B in the outer bracket 34 to secure the inner bracket and the outer bracket together with the frame 20 and the covering 29 disposed therebetween. In addition, each inner bracket 32 is provided with at least one larger-diameter tapped (e.g. internally-threaded) hole 38A and each outer bracket 34 is provided with at least one larger-diameter through hole 38B. Each hole 38A and each hole 38B align with a corresponding one of the larger-diameter holes 28 in the frame 20 and the matching through hole in the covering 29, for a purpose to be described hereinafter.

Figure 3:
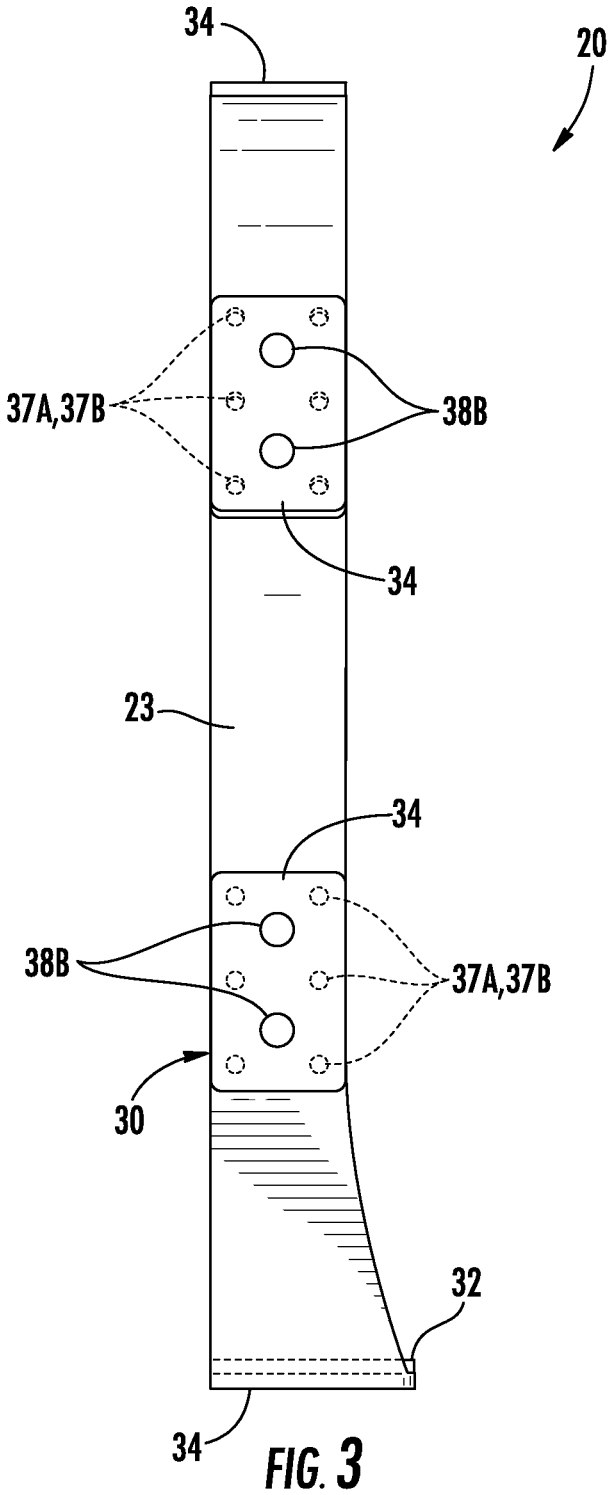
FIG. 3 is a side elevation view showing the frame and a pair of the frame brackets of FIG. 2.
Figure 4:
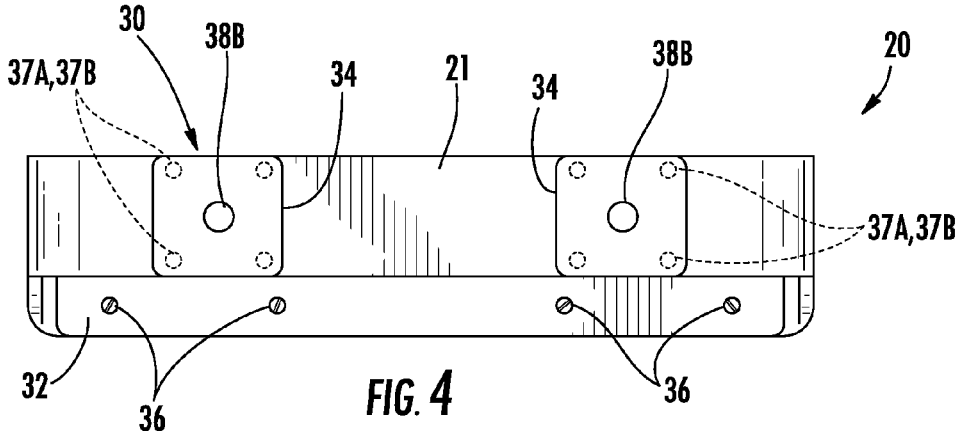
FIG. 4 is a top plan view showing the frame and a pair of the frame brackets of FIG. 2.
Figure 5:
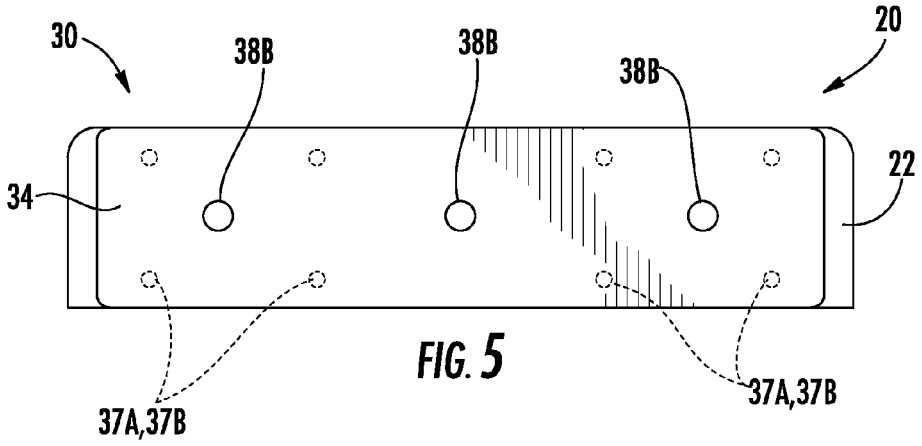
FIG. 5 is a bottom plan view showing the frame and one of the frame brackets of FIG. 2.

FIG. 3 shows two frame brackets 30 secured onto one of the sides 23 of the frame 20 with the covering 29 not shown for purposes of clarity. When viewing the side 23 of the frame 20, the two outer brackets 34 each having a pair of larger-diameter through holes 38B are visible, while the twelve smaller-diameter through holes 37A of the inner bracket 32 and the twelve smaller-diameter tapped holes 37B of the outer bracket 34 are not visible, as indicated by the broken lines in FIG. 3. The larger-diameter tapped holes 38A of the inner brackets 32 are located beneath holes 38B, and thus, likewise are not visible. FIG. 4 shows two frame brackets 30 secured onto the top 21 of the frame 20. When viewing the top 21 of the frame 20, the two outer brackets 34 each having a single larger-diameter through hole 38B are visible, while the eight smaller-diameter through holes 37A and the eight smaller-diameter tapped holes 37B of the outer bracket 34 are not visible, as indicated by the broken lines in FIG. 4. Again, the larger-diameter tapped holes 38A of the inner brackets 32 are located beneath holes 38B, and thus, likewise are not visible. FIG. 5 shows a single frame bracket 30 secured onto the bottom 22 of the frame 20. Similarly, when viewing the bottom 22 of the frame 20, the outer bracket 34 and the three larger-diameter through holes 38B are visible, while the eight smaller-diameter holes 37A, 37B of the inner bracket 32 and the outer bracket 34, respectively, are not visible, as indicated by the broken lines in FIG. 5. Again, the larger-diameter tapped holes 38A are located beneath the holes 38B, and thus, likewise are not visible.

Figure 6:
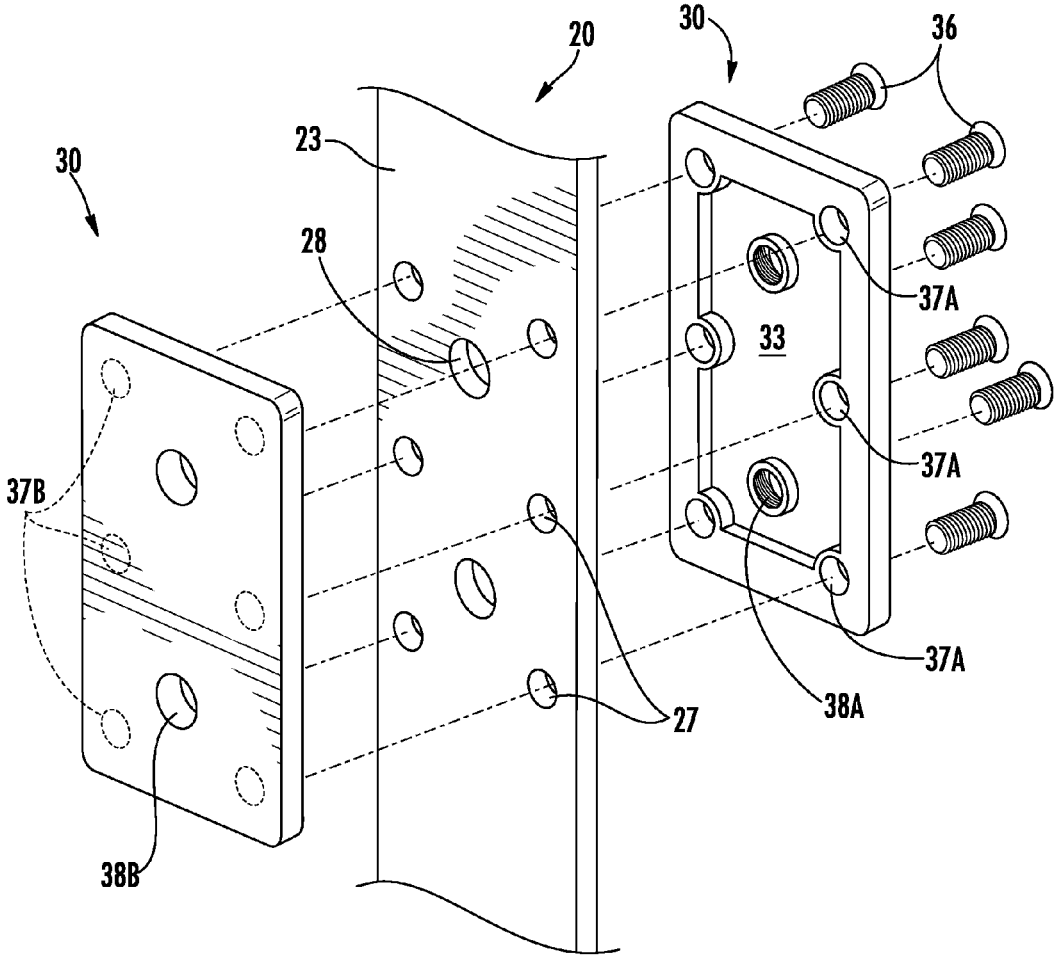
FIG. 6 is an exploded perspective view showing a portion of the frame and one of the frame brackets of FIG. 2 in a disassembled configuration.
Figure 7:
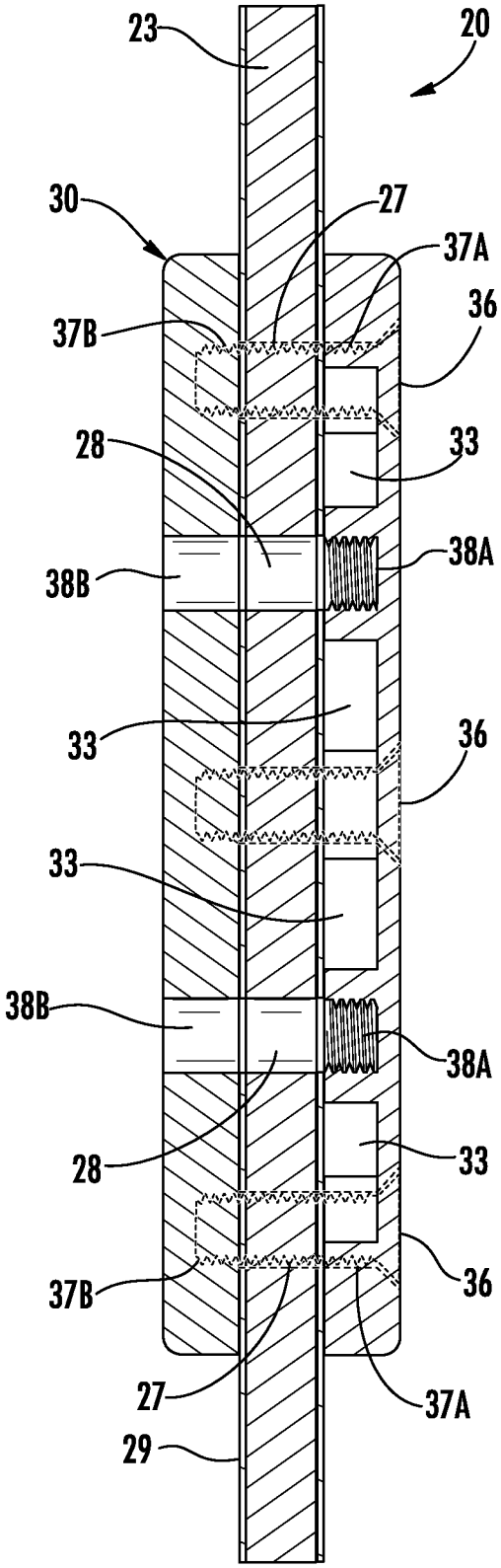
FIG. 7 is a cross-sectional view showing the portion of the frame and the frame bracket of FIG. 6 in an assembled configuration.

FIG. 6 shows a portion of the frame 20 and a typical one of the frame brackets 30 in a disassembled configuration. FIG. 7 shows the portion of the frame 20 and the typical frame bracket 30 in an assembled configuration. As previously mentioned, the frame 20, and by way of example one of the sides 23 of the frame, is formed with a plurality (i.e., six) of the smaller-diameter through holes 27 and at least one (i.e., two) of the larger-diameter through holes 28. Frame bracket 30 comprises inner bracket 32 and outer bracket 34. Inner bracket 32 has a plurality (i.e., six) of the smaller-diameter through holes 37A, and outer bracket 34 has a corresponding plurality (i.e., six) of the smaller-diameter tapped holes 37B. A corresponding plurality of fasteners (i.e., six threaded machine screws) 36 pass through the holes 37A of the inner bracket 32 and engage the corresponding tapped holes 37B of the outer bracket 34 to secure the frame bracket 30 with the frame 20 (i.e., side 23) disposed between the inner bracket and the outer bracket. If desired, the inner bracket 32 may be provided with an interior pocket 33. Regardless, inner bracket 32 is formed with at least one (i.e., two) of the larger-diameter tapped holes 38A and outer bracket 34 is formed with a corresponding number (i.e., two) of the through holes 38B, for a purpose to be described with reference to FIG. 9.

It should be noted, as will be readily understood and appreciated by those skilled in the art, that the two frame brackets 30 secured onto the upper rear flange 25 and the two frame brackets 30 secured onto the pair of lower rear flanges 26 are assembled in essentially the manner illustrated in FIG. 6 and FIG. 7. The two frame brackets 30 secured onto the top 21 of the frame 20 and the single frame bracket 30 secured onto the bottom 22 of the frame 20 are likewise assembled in essentially the same manner, except for the number of through holes 37A, 38B, tapped holes 37B, 38A, and the number of fasteners 36 required. It should also be noted that FIG. 7 illustrates the covering 29 encasing the frame 20, such that the inner bracket 32 having fasteners 36 is visible when the frame is viewed from within the interior compartment 24 and the outer bracket 34 having larger-diameter through holes 38B is visible when the frame 20 is viewed from the exterior. If desired, it is contemplated that the covering 29 may be applied to the frame 20 after the frame brackets 30 are secured onto the frame. In this alternative embodiment, the covering 29 need only be provided with through holes corresponding to the larger-diameter through holes 38B of the outer brackets 34 of the frame brackets 30. Furthermore, the inner brackets 32 (including fasteners 36) will not be visible when the frame 20 is viewed from within the interior compartment 24 and the outer brackets 34 (except for holes 38B) will not be visible when the frame 20 is viewed from the exterior. Such a modification to the assembly of the frame 20 and the frame brackets 30 is considered to require no more than an ordinary level of skill in the art, and consequently, is intended to be encompassed by the invention, as defined by the claims appended hereto.

Figure 8:
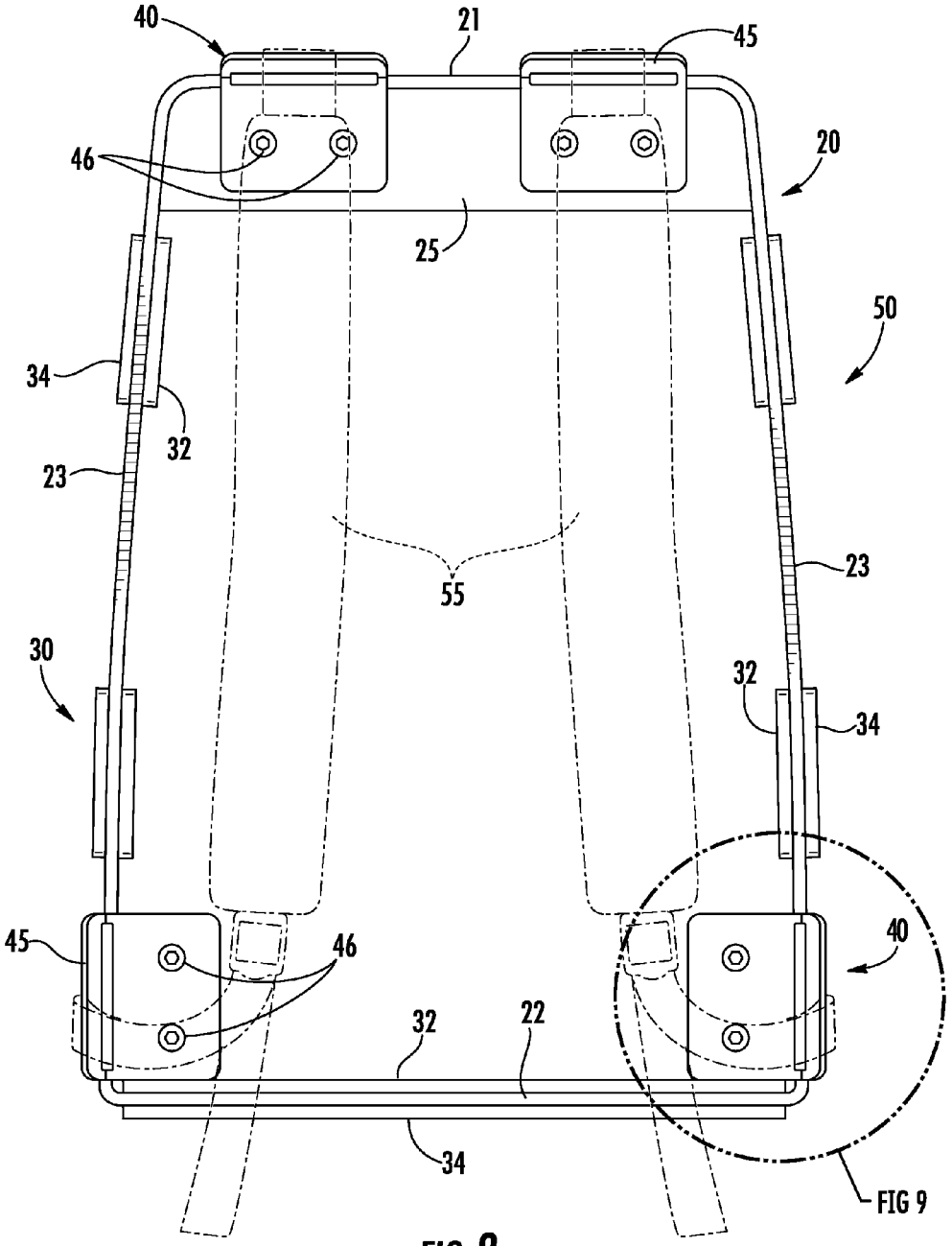
FIG. 8 is a rear elevation view showing an exemplary embodiment of a frame assembly according to the invention configured as a backpack.

FIG. 8 shows an exemplary embodiment of a frame assembly according to the present invention configured as a backpack 50. As shown in FIG. 8, the frame assembly 50 comprises a frame 20 and a plurality of frame brackets 30 constructed and assembled as previously described. In particular, inner brackets 32 and corresponding outer brackets 34 are secured onto the top 21, bottom 22, sides 23, upper rear flange 25 and lower rear flanges 26 with the frame 20, and typically covering 29, disposed between the inner brackets and the outer brackets. In addition, the frame assembly 50 further comprises a plurality (i.e., four) of connector pieces 40 attached to certain ones of the frame brackets 30. As shown herein with reference to backpack 50, a connector piece 40 is attached to each of the two frame brackets 30 secured onto the upper rear flange 25 of the frame 20 and to each of the two frame brackets 30 secured onto the lower rear flanges 26 of the frame. Furthermore, a backpack strap 55 extends between a connector piece 40 attached to the upper rear flange 25 and a connector piece 40 attached to one of the lower rear flanges 26. More particularly, a pair of straps 55 is provided on the rear of the frame 20 between the two connector pieces 40 attached to the upper rear flange 25 and the two connector pieces 40 attached to the lower rear flanges 26 so as to allow a user to support the backpack 50 with the straps 55 on his or her shoulders in a conventional manner.

Figure 9:
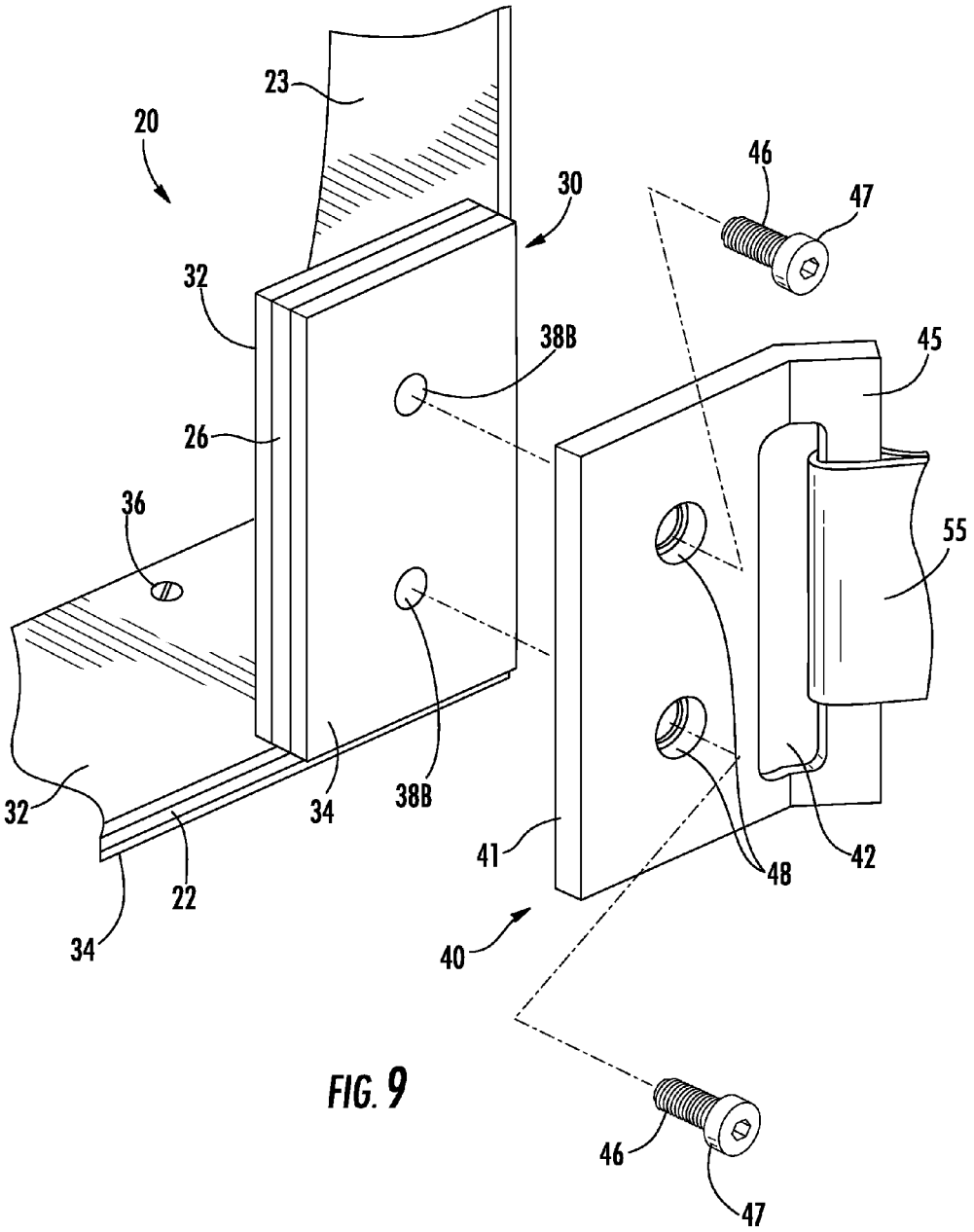
FIG. 9 is a detail exploded perspective view showing a portion of the frame, one of the frame brackets and a corresponding one of the connector pieces in a partially disassembled configuration.

FIG. 9 illustrates one of the connector pieces 40 being attached to a frame bracket 30 secured onto one of the lower rear flanges 26 of the frame 20. As shown herein, the connector piece 40 may comprise a generally rectangular base portion 41 and a generally rectangular angled portion 45 depending from the base portion. The connector piece further has a through slot 42 disposed between the base portion 41 and the angled portion 45. The slot 42 is sized and shaped to receive an end of the strap 55 of the backpack 50 in a conventional manner. Connector piece 40 further has at least one through hole 48 for receiving a fastener 46 (e.g., a threaded machine screw) to attach the connector piece to a frame bracket 30. As shown in the exemplary embodiment depicted in FIG. 8 and FIG. 9, each connector piece 40 has a pair of through holes 48 configured for receiving a pair of fasteners 46 to attach the connector piece to a corresponding frame bracket 30. More specifically, the fasteners 46 pass within the larger-diameter through holes 38B of the outer bracket 34 and engage the larger-diameter tapped holes 38A of the inner bracket 32. If desired, the through holes 48 may be provided with a countersink in a manner well known to those skilled in the art so that the heads 47 of the fasteners 46 are flush with the outer surface of the base portion 41 of the connector piece 40 when the fasteners are fully engaged with the frame bracket 30. Alternatively, the heads 47 of the fasteners 46 may extend outwardly beyond the outer surface of the base portion 41 so that the frame assembly 50 has an industrial appearance as opposed to a finished appearance.

Figure 10A:
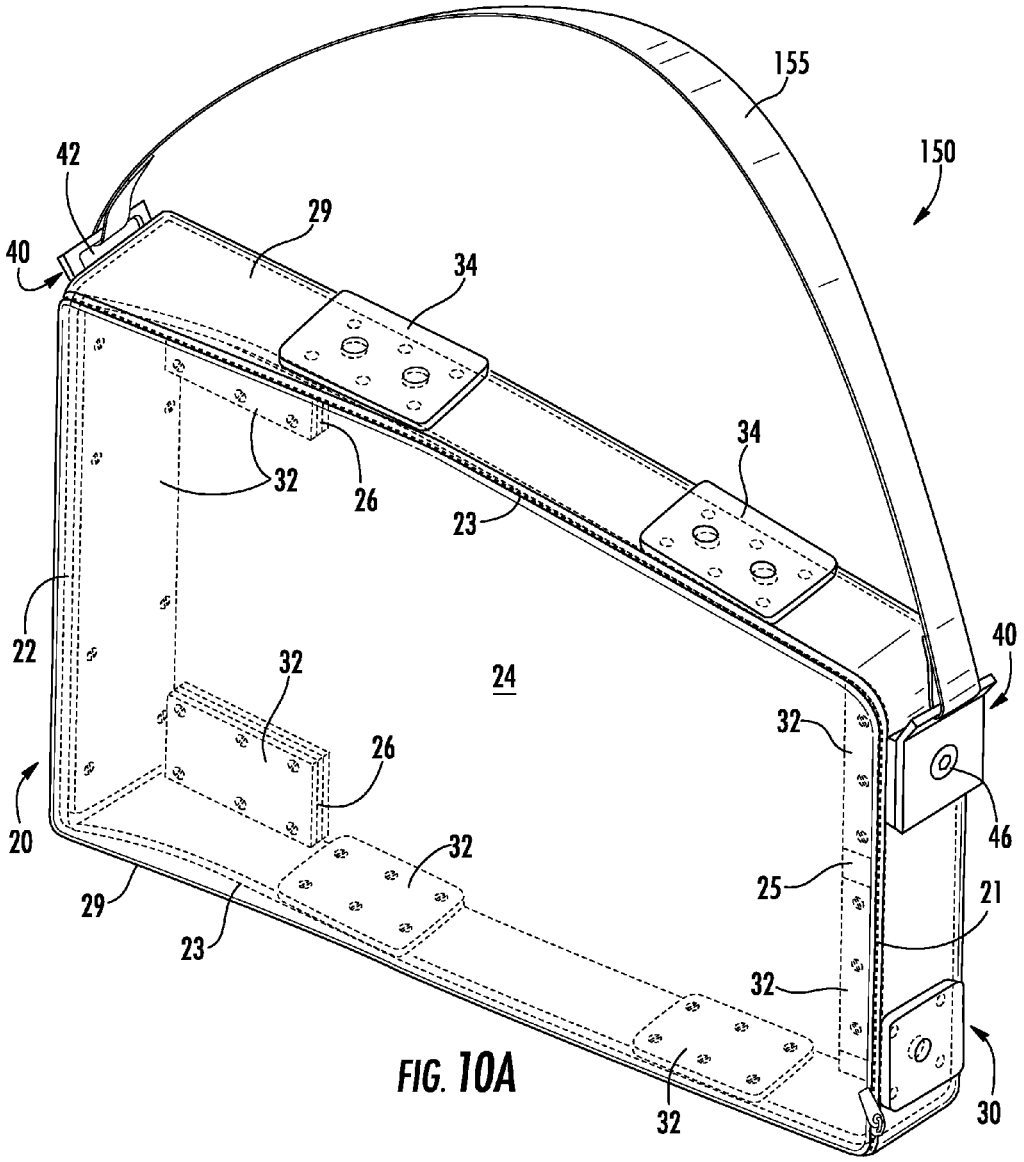
FIG. 10A is a front perspective view showing another exemplary embodiment of a frame assembly according to the invention configured as a book bag or a computer case.

FIG. 10A shows another exemplary embodiment of a frame assembly according to the invention configured as a book bag or a computer case 150. As shown, the frame assembly 150 comprises a frame 20 and a plurality of frame brackets 30 constructed and assembled as previously described. In particular, inner brackets 32 and corresponding outer brackets 34 are secured onto the top 21, bottom 22, sides 23, upper rear flange 25 and lower rear flanges 26 with the frame 20, and typically covering 29, disposed between the inner brackets and the outer brackets. In addition, the frame assembly 150 further comprises a plurality (i.e., two) of connector pieces 40 attached to certain ones of the frame brackets 30. As shown, a connector piece 40 is attached to one of the two frame brackets 30 secured onto the top 21 of the frame 20 and to the single frame bracket 30 secured onto the bottom 22 of the frame. Furthermore, a book bag or computer case strap 155 extends between the two connector pieces 40. More particularly, a single strap 155 is provided on one side 23 of the frame 20 to allow a user to support the book bag or computer case 150 with the strap 155 over one of his or her shoulders in a conventional manner.

Figure 10B:
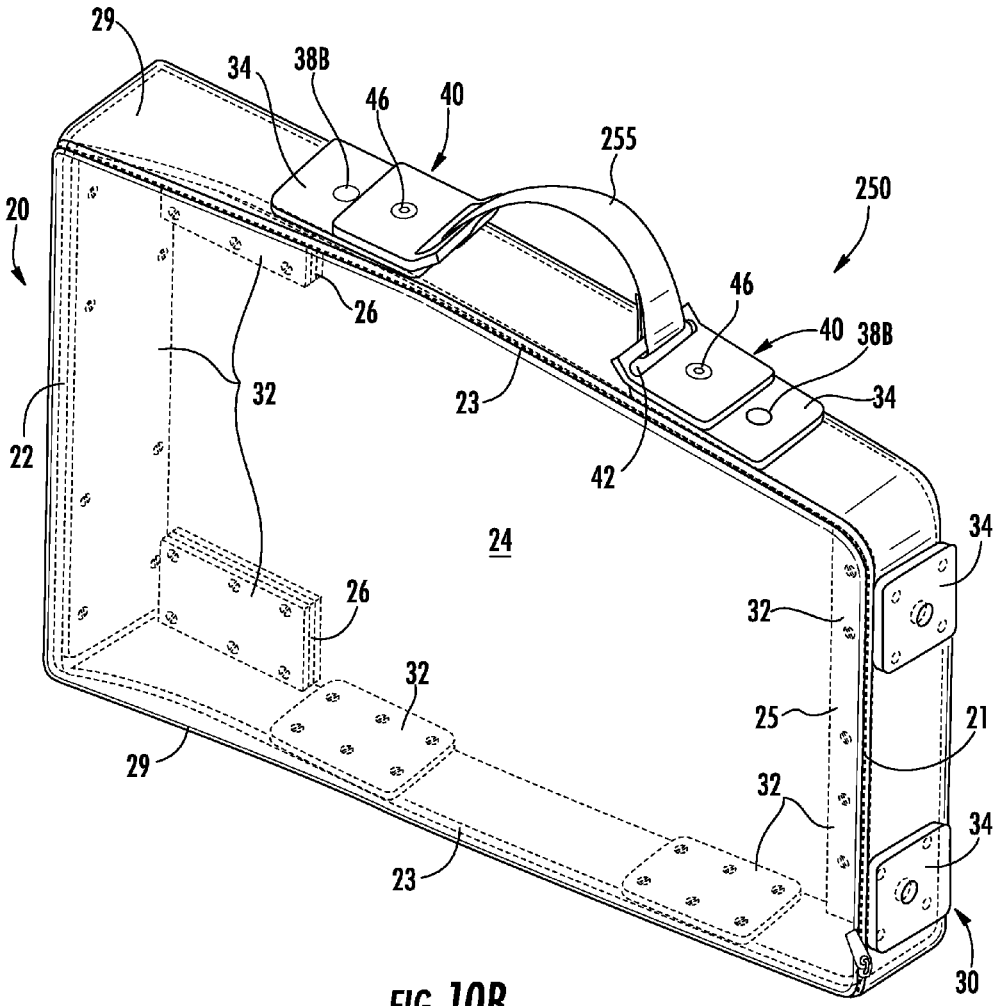
FIG. 10B is a front perspective view showing another exemplary embodiment of a frame assembly according to the invention configured as a briefcase.

FIG. 10B shows another exemplary embodiment of a frame assembly according to the invention configured as a briefcase 250. As shown, the frame assembly 250 comprises a frame 20 and a plurality of frame brackets 30 constructed and assembled as previously described. In particular, inner brackets 32 and corresponding outer brackets 34 are secured onto the top 21, bottom 22, sides 23, upper rear flange 25 and lower rear flanges 26 with the frame 20, and typically covering 29, disposed between the inner brackets and the outer brackets. In addition, the frame assembly 250 further comprises a plurality (i.e., two) of connector pieces 40 attached to certain ones of the frame brackets 30. As shown, a connector piece 40 is attached to an inner portion of each of the two frame brackets 30 secured onto one of the sides 23 of the frame 20. Furthermore, a briefcase handle 255 extends between the two connector pieces 40 attached to the two frame brackets 30 secured onto the side 23 of the frame 20. More particularly, a single handle 255 is provided on one side 23 of the frame 20 to allow a user to grasp and carry the briefcase 250 by the handle 255 in a conventional manner.

Figure 11A:
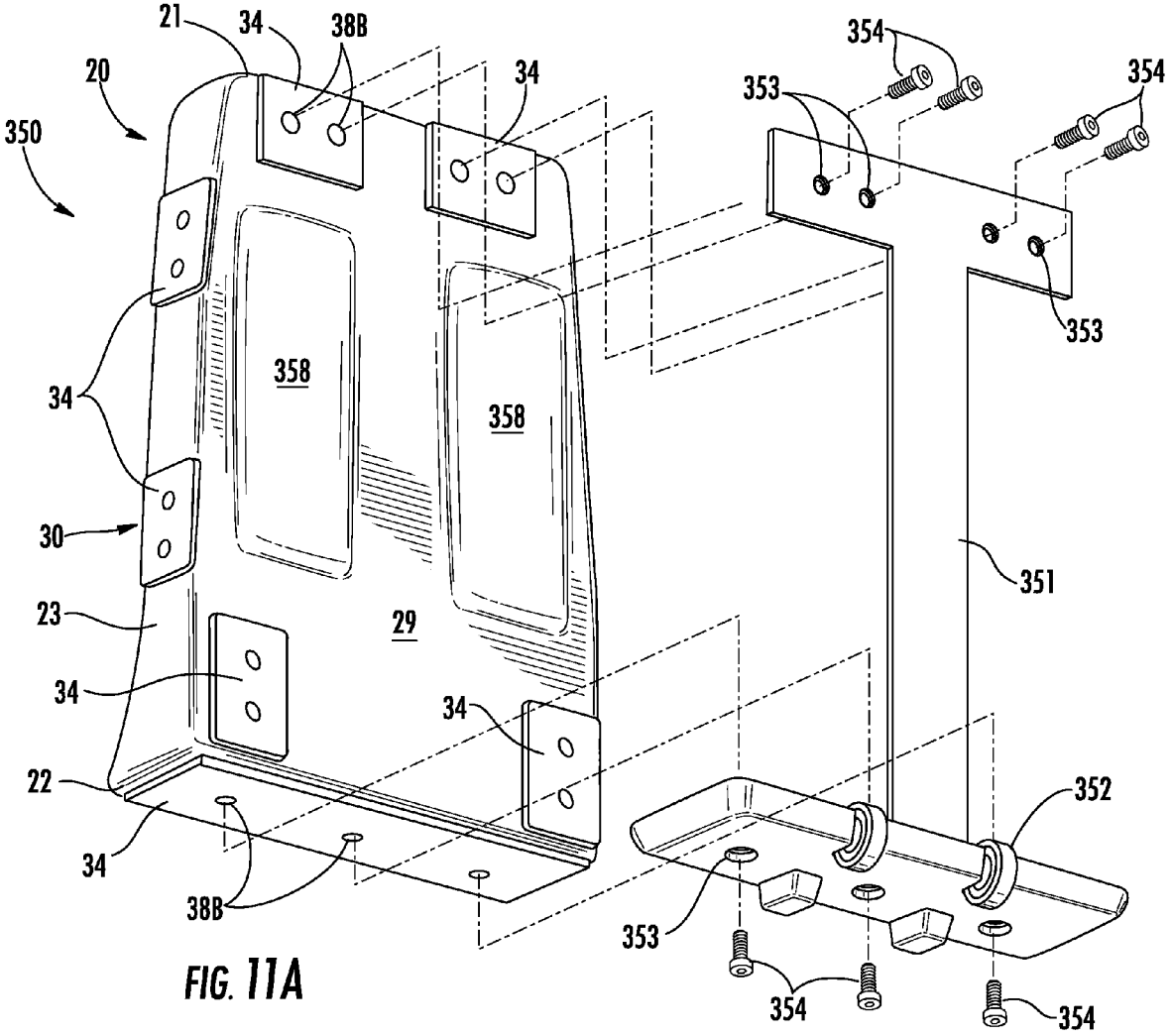
FIG. 11A is a rear perspective view showing another exemplary embodiment of a frame assembly according to the invention configured as rolling carry-on luggage.
Figure 11B:
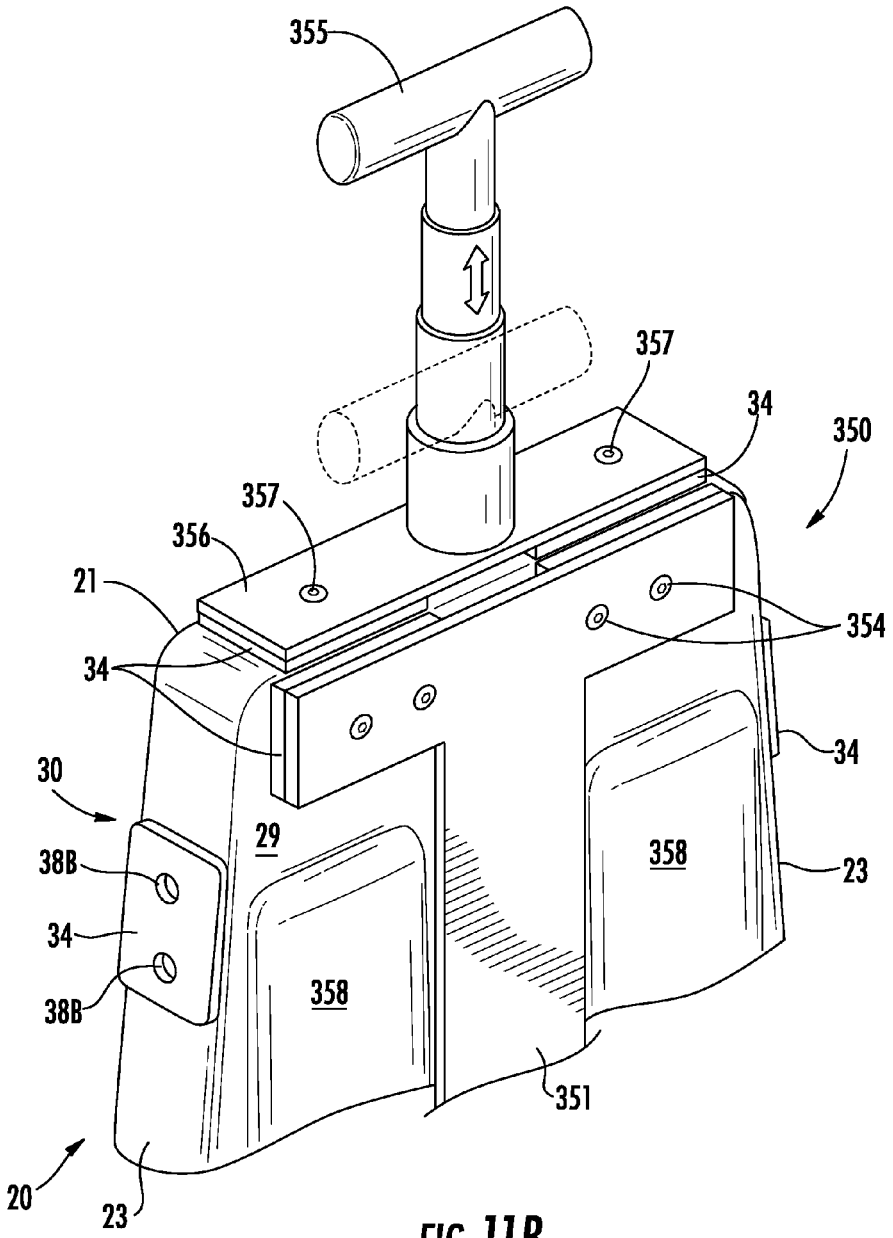
FIG. 11B is a detail rear perspective view showing an extensible handle of the rolling carry-on luggage of FIG. 11A.

FIG. 11A and FIG. 11B show another exemplary embodiment of a frame assembly according to the invention configured as rolling carry-on luggage 350. As shown, the frame assembly 350 comprises a frame 20 and a plurality of frame brackets 30 constructed and assembled as previously described. In particular, inner brackets (not shown) and corresponding outer brackets 34 are secured onto the top 21, bottom 22, sides 23, upper rear flange (not shown) and lower rear flanges (not shown) with the frame 20, and typically covering 29, disposed between the inner brackets and the outer brackets. In addition, the frame assembly 350 further comprises a roller assembly 351 having a plurality (i.e., two) wheels, rollers or the like 352 disposed thereon. In addition, the roller assembly 351 has a plurality of through holes 353 configured for receiving a corresponding plurality of fasteners 354 to attach the roller assembly to the frame 20 of the frame assembly 350. As shown, the roller assembly 351 is attached to the two frame brackets 30 secured onto the upper rear flange of the frame 20 and to the frame bracket 30 secured onto the bottom 22 of the frame.

Furthermore, as shown in FIG. 11B, the rolling carry-on luggage 350 further comprises an extensible (e.g., telescoping) handle 355 that is configured to extend outwardly from the top 21 of the frame. More particularly, the extensible handle 355 comprises a base 356 that is attached to the two frame brackets 30 secured onto the top 21 of the frame 20 by fasteners 357 that pass through the holes 38B in the outer bracket 34 to engage the tapped holes 38A in the inner bracket (not shown). The extensible handle 355 is provided on the top 21 of the frame 20 and extends outwardly therefrom so as to allow a user to grasp and pull the handle to maneuver the rolling carry-on luggage 350 over a generally planar surface in a conventional manner. If desired, the covering 29 of the frame 20 may be provided with one or more scuff pads 358 configured for protecting the covering of the frame from excessive wear in a known manner.

It should be noted that the straps 55 of the frame assembly 50, the strap 155 of the frame assembly 150, the handle 255 of the frame assembly 250, and the extensible handle 355 of the frame assembly 350 are configured to be readily interchangeable on the frame 20 and frame brackets 30. More particularly, at least one connector piece 40 is attached to a corresponding one of the frame members 30, and an accessory component (such as the straps 55, the strap 155, the handle 255 and the extensible handle 355 examples shown and described herein) is attached to the at least one connector piece. In this manner, the frame 20 and the frame brackets 30 could be sold separately from the connector pieces 40 and the accessory components, for example straps 55, strap 155, handle 255 and/or extensible handle 355. Thus, a purchaser could select desired accessory components to create a customized carrying bag suitable for his or her current needs. In addition, the straps 55, the strap 155, the handle 255 and the extensible handle 355, as well as other accessory components, could be sold in different sizes, colors and/or shapes and/or with printed indicia, such as a team logo or school emblem, thereon. Accordingly, a purchaser could select an accessory component, such as straps 55, strap 155, handle 255 and/or extensible handle 355, having a desired design so as to create a customized carrying bag that is also personalized according to his or her tastes, interests and desires.

The foregoing detailed description of the invention in conjunction with the accompanying drawing figures has shown exemplary embodiments of a frame assembly for a customized carrying bag. In exemplary embodiments, a frame assembly according to the invention includes a frame defining a continuous outer periphery and an interior compartment. A plurality of frame brackets are secured onto a top, a bottom, a pair of opposite sides, an upper rear flange, and a pair of lower rear flanges of the frame. One or more connector pieces are then attached to certain ones of the frame brackets. A pair of straps, a single strap, a handle and/or an extensible handle are/is then attached to the connector pieces. In this manner, a user can configure the frame assembly as a customized carrying bag, for example as a backpack, a book bag or a computer case, a briefcase or rolling carry-on luggage. In addition, a user may select a particular pair of straps, strap handle and/or extensible handle to create a customized carrying bag that is also personalized to his or her tastes, interests and/or desires.

That which is claimed is:

1. A frame assembly for a customized carrying bag, comprising:

a covering made of a relatively flexible material;

a frame defining a periphery, the frame at least partially encased within the covering such that the frame and the covering define an interior compartment of the carrying bag, the frame and the covering having a plurality of smaller-diameter through holes and at least one larger-diameter through hole at each of a plurality of locations around the periphery of the frame;

at least one inner frame bracket having a plurality of smaller-diameter through holes corresponding to the plurality of smaller-diameter through holes of the frame and the covering and at least one larger-diameter tapped hole corresponding to the at least one larger-diameter through hole of the frame and the covering; and at least one outer frame bracket having a plurality of smaller-diameter tapped holes corresponding to the plurality of smaller-diameter through holes of the frame and the covering and at least one larger-diameter through hole corresponding to the larger diameter through hole of the frame and the covering;

wherein the inner frame bracket and the outer frame bracket are secured together with the frame and the covering disposed between the inner frame bracket and the outer frame bracket by a plurality of first fasteners that pass through the smaller-diameter through holes of the inner frame bracket and the smaller-diameter through holes of the frame and the covering from an interior of the frame to engage with the smaller-diameter tapped holes of the outer frame bracket.

2. A frame assembly according to claim 1, further comprising at least one connector piece having at least one larger-diameter through hole, and wherein the connector piece is secured onto the outer frame bracket by a second fastener that passes through the larger-diameter through hole of the outer frame bracket and the larger-diameter through hole of the frame and the covering from an exterior of the frame to engage with the larger-diameter tapped hole of the inner frame bracket.

3. A frame assembly according to claim 1, wherein the frame comprises a top, a bottom, and a pair of opposite sides that extend between and join together ends of the top and the bottom, the top having a width that is narrower side-to-side than a width of the bottom such that the frame is narrower at the top than at the bottom.

4. A frame assembly according to claim 3, wherein the frame further comprises an upper rear flange adjacent the top and extending between the pair of opposite sides, the upper rear flange having a plurality of smaller-diameter through holes and at least one larger-diameter through hole; and at least one lower rear flange adjacent an end of the bottom and one of the pair of opposite sides, the lower rear flange having a plurality of smaller-diameter through holes and at least one larger-diameter through hole.

5. A frame assembly according to claim 1, further provided with an accessory component comprising a pair of straps attached to connector pieces at opposite ends of the straps with the connector pieces being secured onto corresponding outer frame brackets on the exterior of the frame so as to create a backpack.

6. A frame assembly according to claim 1, further provided with an accessory component comprising a strap attached to connector pieces at opposite ends of the strap with the connector pieces being secured onto corresponding outer frame brackets on the exterior of the frame so as to create a book bag or a computer case.

7. A frame assembly according to claim 1, further provided with an accessory component comprising a handle attached to connector pieces at opposite ends of the handle with the connector pieces being secured onto corresponding outer frame brackets on the exterior of the frame so as to create a briefcase.

8. A frame assembly according to claim 1, further provided with an accessory component comprising at least one wheel, roller or the like and an extensible handle attached to connector pieces that are secured onto corresponding outer frame brackets on the exterior of the frame so as to create a rolling carry-on luggage.

9. A frame assembly according to claim 1, further provided with an accessory component to create at least one of a backpack, a book bag, a computer case, a briefcase and a rolling carry-on luggage bag, and wherein the accessory component has printed indicia thereon so as to create a customized carrying bag that is personalized.

10. A frame assembly for a customized carrying bag, comprising:

a frame made of a relatively flexible, yet resilient material, the frame defining a continuous periphery, the frame having a plurality of smaller-diameter through holes and at least one larger-diameter through hole at each of a plurality of locations around the periphery of the frame;

a covering with the frame at least partially encased within the covering, the covering and the frame defining an interior compartment, the covering having a plurality of smaller-diameter through holes corresponding to the smaller-diameter through holes of the frame and at least one larger-diameter through hole corresponding to the larger-diameter through hole of the frame at each of the plurality of locations around the periphery of the frame;

a plurality of frame brackets, each frame bracket comprising an inner frame bracket and an outer frame bracket, the inner frame bracket having a plurality of smaller-diameter through holes corresponding to the smaller-diameter through holes of the frame and the smaller-diameter through holes of the covering, and at least one larger-diameter tapped hole corresponding to the larger-diameter through hole of the frame and the larger-diameter through hole of the covering, the outer frame bracket having a plurality of smaller-diameter tapped holes corresponding to the smaller-diameter through holes of the frame, the smaller-diameter through holes of the covering and the smaller-diameter through holes of the inner frame bracket, and at least one larger-diameter through hole corresponding to the larger-diameter through hole of the frame, the larger-diameter through hole of the covering and the larger-diameter tapped hole of the inner frame bracket; and at least one connector piece attached to a corresponding one of the frame brackets and secured onto the outer frame bracket on an exterior of the frame assembly, the connector piece having at least one larger-diameter through hole corresponding to the larger-diameter through hole of the outer frame bracket, the larger-diameter through hole of the frame, the larger-diameter through hole of the covering and the larger-diameter tapped hole of the inner frame bracket;

wherein the inner frame bracket and the outer frame bracket are secured together by a plurality of first fasteners that pass through the smaller-diameter through holes of the inner frame bracket, the smaller-diameter through holes of the frame and the smaller-diameter through holes of the covering to engage with the smaller-diameter tapped holes of the outer frame bracket;

wherein the connector piece is attached to the frame bracket by at least one second fastener that passes through the larger-diameter through hole of the connector piece, the larger-diameter through hole of the outer frame bracket, the larger-diameter through hole of the frame and the larger-diameter through hole of the covering to engage with the larger-diameter tapped hole of the inner frame bracket; and wherein an accessory component is attached to the connector piece that is secured onto the outer frame bracket at two or more of the plurality of locations around the periphery of the frame.

11. A frame assembly according to claim 10, wherein the frame comprises a top, a bottom having a width that is greater than a width of the top, and a pair of opposite sides that extend between and join ends of the top and the bottom, and wherein the frame further comprises an upper rear flange depending from the top of the frame and a pair of lower rear flanges that each depend from the bottom adjacent a respective side, and wherein the accessory component comprises a pair of straps each having opposite ends that are attached to connector pieces with the connector pieces secured onto corresponding outer frame brackets located on the upper rear flange of the frame and the lower rear flange of the frame so as to create a backpack.

12. A frame assembly according to claim 10, wherein the frame comprises a top, a bottom, and a pair of opposite sides that extend between and join ends of the top and the bottom, and wherein the accessory component comprises a strap having opposite ends that are attached to connector pieces with the connector pieces secured onto corresponding outer frame brackets located on the top of the frame and the bottom of the frame so as to create a book bag or a computer case.

13. A frame assembly according to claim 10, wherein the frame comprises a top, a bottom, and a pair of opposite sides that extend between and join ends of the top and the bottom, and wherein the accessory component comprises a handle having opposite ends that are attached to connector pieces with the connector pieces secured onto one or more corresponding outer frame brackets located on one of the opposite sides of the frame so as to create a briefcase.

14. A frame assembly according to claim 10, wherein the frame comprises a top, a bottom, and a pair of opposite sides that extend between and join ends of the top and the bottom, and wherein the frame further comprises an upper rear flange depending from the top of the frame and a pair of lower rear flanges that each depend from the bottom adjacent a respective side, and wherein the accessory component comprises an extensible handle having at least one wheel, roller or the like that is attached to connector pieces with the connector pieces secured onto one or more corresponding outer frame brackets located on at least one of the top of the frame and the upper rear flange of the frame, and at least one of the bottom of the frame and the pair of lower rear flanges of the frame so as to create a rolling carry-on luggage.

15. A frame assembly for a customizable carrying bag, comprising:

a frame defining a continuous periphery and having an interior defining an interior compartment of the carrying bag and an exterior opposite the interior, the frame comprising a top, a bottom and a pair of opposite sides that extend between and join ends of the top and the bottom, the top having a side-to-side width that is narrower than a side-to-side width of the bottom, the frame further comprising an upper rear flange that depends from the top and at least one lower rear flange that depends from the bottom adjacent a respective one of the opposite sides, the frame having a plurality of smaller-diameter through holes and at least one larger-diameter through hole at each of a plurality of locations around the periphery of the frame, on the upper rear flange of the frame and on the lower rear flange of the frame;

a frame bracket at one or more of the plurality of locations; and a connector piece attached to a corresponding frame bracket at each of the one or more of the plurality of locations, the connector piece having an accessory component attached thereto to create one of a backpack, a book bag, a computer case, a briefcase and a rolling carry-on luggage;

wherein each frame bracket comprises an inner frame bracket positioned adjacent the interior of the frame and an outer frame bracket positioned adjacent the exterior of the frame;

wherein each inner frame bracket has a plurality of smaller-diameter though holes corresponding to the plurality of smaller-diameter through holes of the frame and at least one larger-diameter tapped hole corresponding to the larger-diameter through hole of the frame;

wherein each outer frame bracket has a plurality of smaller-diameter tapped holes corresponding to the smaller-diameter through holes of the frame and the smaller-diameter through holes of the inner frame bracket and at least one larger-diameter through hole corresponding to the larger-diameter through hole of the frame and the larger-diameter tapped hole of the inner frame bracket;

wherein the inner frame bracket and the outer frame bracket are secured together by a plurality of first fasteners that pass through the plurality of smaller-diameter through holes of the inner frame bracket and the smaller-diameter through holes of the frame from the interior of the frame and engage with the smaller-diameter tapped holes of the outer frame bracket; and wherein the connector piece is secured onto the outer frame bracket by at least one second fastener that passes through the larger-diameter through hole of the outer frame bracket and the larger-diameter through hole of the frame from the exterior of the frame and engages with the larger-diameter tapped hole of the inner frame bracket.

* * * * *